United States Patent [19]

Gentry et al.

[11] 4,429,739

[45] Feb. 7, 1984

[54] HEAT EXCHANGER

[75] Inventors: Cecil C. Gentry; William M. Small, both of Bartlesville, Okla.

[73] Assignee: Phillips Petroleum Company, Bartlesville, Okla.

[21] Appl. No.: 182,741

[22] Filed: Aug. 29, 1980

[51] Int. Cl.[3] ..... F28F 9/00; F28F 9/24

[52] U.S. Cl. ..... 165/159; 165/162

[58] Field of Search ..... 165/159, 162

[56] References Cited

U.S. PATENT DOCUMENTS

| | | | |
|---|---|---|---|
| 2,059,967 | 11/1936 | Leach | 165/162 X |
| 2,916,264 | 12/1959 | Rhodes | 259/239 |
| 2,919,903 | 1/1960 | Vautrain | 257/32 |
| 2,937,079 | 5/1960 | Van Pool | 23/285 |
| 3,708,142 | 1/1973 | Small | 248/49 |
| 3,907,031 | 9/1975 | Tegethoff | 165/162 |
| 4,127,165 | 11/1978 | Small | 165/162 |
| 4,136,736 | 1/1979 | Small | 165/162 |
| 4,213,499 | 7/1980 | Straffi | 122/510 X |
| 4,286,366 | 9/1981 | Vinyard | 122/510 X |

OTHER PUBLICATIONS

Williams, H. K., "System 80 NSSS Steam Generator Design", presented at American Power Conference, Chicago, IL, Apr. 20-22, 1976.

*Primary Examiner*—Albert W. Davis, Jr.

[57] ABSTRACT

The tubes in a U-tube bundle are supported by rod baffles characterized by inner and outer arcuate rod support members. Methods and apparatus for assembling the components of the heat exchanger are also provided.

4 Claims, 23 Drawing Figures

HEAT EXCHANGER

BACKGROUND OF THE INVENTION

The present invention relates to a heat exchanger and certain improvements thereto. In other aspects, the invention relates to the assembly of a heat exchanger and its components.

Heat exchangers, especially those utilized for steam generation, suffer from many problems. The problems encountered include corrosion phenomena, such as cracking, pitting, wastage, and denting of the tubes; mechanical phenomena, such as water hammer, vibration, cavitation, and tube splitting and fatigue; and functional phenomena, such as poor heat exchange, high pressure drop, and low throughput.

Heat exchangers for steam generation are designed to evaporate water. However, if conditions exist that cause a local region to dry out (i.e., all the water to vaporize), aggressive chemicals can concentrate and deposit in that region, harming metallic structures. In steam generators, the heating fluid passes on the inside of the tube bundle, and the fluid to be heated and vaporized flows around the outside of the tube bundle. Dry-out conditions commonly occur at the interfaces between the tubes and the support elements on the outside of the tubes. Crevices which exist between the tubes and the support elements and also the tubes and the tube sheet are especially prone to dry-out conditions. Dry-out and high chemical concentrations in these crevices can cause tube denting and cracking and lead to premature failure of the tube bundle. Tube denting occurs when the carbon steel tube support element exhibits fast linear corrosion at the location where the tube passes through it. The corrosion product occupies a greater volume than the original support element metal and squeezes down on the tube, deforming it. If corrosion continues, gross deformation and eventual cracking of the support element and tube can result. Similar problems are seen in crevices between the tube and the tube sheet.

Dryout can often occur at the interface between the tube and sludge accumulations in the shell side of the heat exchanger. Sludge accumulations up to 12 inches thick have been measured on the tube sheets of operating vertically oriented steam generators. When phosphate water chemistries are employed, wall thinning of the steam generator tubes sometimes occurs in the sludge pile.

Tube vibration and collision can damage the tubes. Normally, clearance exists between the tubes of the bundle and the tube supporting elements. Such clearances are normally required for manufacture of the tube bundle. Fluid flowing parallel to, perpendicular to, or at some intermediate angle to the tubes induces tube vibration. This vibration may cause a tube to hit or slide against support elements and/or adjacent tubes, resulting in local wear damage. Because the movement between the surfaces is oscillatory and usually of small amplitude, the rubbing process is termed "fretting". Fretting causes tube metal loss, support element metal loss, and fretted regions are sensitive to fatigue cracking.

Water hammer can also damage the tubes of the bundle of a steam generator. Water hammer is thought to be caused this way:

(1) feed flow is interrupted, and susceptible regions fill with steam;

(2) when feed flow resumes, a volume of steam is trapped and rapidly collapses because of heat transfer to the colder feed water;

(3) the rapid collapse of the steam volume creates a pressure differential that accelerates a slug of water through the susceptible region; and (4) the accelerating slug of water impacts (hammers) a barrier.

OBJECTS OF THE INVENTION

It is an object of this invention to provide a steam generator in which the parts are ruggedly sized and attached in a manner that minimizes stresses and deflections under loading conditions.

It is another object of this invention to provide a steam generator in which the design of the internal parts is as simple and as uncomplicated as possible to minimize the possibility of failure from any cause.

It is another object of this invention to minimize the accumulation of solids in contact with heat transfer surfaces in a steam generator.

It is another object of this invention to provide a steam generator in which the opportunity for stagnant flow regions where localized dryout or steam blanketing might occur which could concentrate dissolved impurities in the boiler water and damage the apparatus is minimized.

It is another object of this invention to improve the heat transfer in an axial flow U-tube bundle.

It is yet another object of this invention to provide methods of assemblying the components of a steam generator at great economy.

These and other objects of the invention will be made further apparent from the following summary, detailed disclosure and drawings.

SUMMARY OF THE INVENTION

According to one aspect of the present invention, a rod baffle comprises inner and outer arc-shaped members and a plurality of parallel rods some of which are affixed to the outer arc-shaped member as chords, others of which establish cooperation between the inner and outer arc-shaped members. The baffle is especially useful for supporting the tubes in a tube bundle laid out in a generally annular array on a tube sheet.

According to another aspect of the invention, a rod baffle comprising a ring with a plurality of rods affixed thereto as parallel chords is provided with a plate which extends at least partially across the diameter of the ring. The improved baffle is especially useful for employment in a U-tube bundle, as the plate can prevent channeling of shell side fluid between the lugs of the tube bundle.

According to another aspect of the present invention, a rod baffle comprising a plurality of rods affixed to a suitable support member so as to form a grate is provided with a stip of contact and support the rods and reduce their unsupported span. In this aspect, the present invention provides a rigid baffle which is especially useful for supporting the tubes in a tube bundle in which the tubes are spaced closely together as compared to the distance across the bundle.

According to another aspect of the present invention, a rod baffle is provided which comprises an arc-shaped outer member, a support member extending at least partially between the ends of the arc-shaped member, and a plurality of parallel rods extending between the arc-shaped member and the support member. In this aspect, the invention is especially useful for supporting the tubes in a U-tube bundle in which a plate at least partially blocks communication between the legs of the bundle.

According to another aspect of the present invention, a baffle cage is provided wherein rod baffles having arc-shaped members are retained in a cage with their arc-shaped members in juxtaposition by at least one support member which cooperates with the ends of the arc-shaped members. In this aspect, the invention is especially useful for supporting the tubes in the legs of a U-tube bundle.

According to another aspect of the present invention, a baffle cage is provided in which rod baffles having outer arc-shaped members and arc-closure members are retained in the cage with their outer arc-shaped members and arc-closure members in juxtaposition by at least one support member which cooperates with the arcclosure members. In this aspect, the present invention is especially useful for supporting the tubes in a U-tube bundle in which the legs of the U are at least partially separated by a plate.

According to another aspect of the present invention, cooperation is established between a shroud and a tube bundle within by providing guide rails along the exterior of the tube bundle and alignment guides along the interior of the shroud suitable for receiving the guide rails on the bundle. In this aspect of the invention, the tube bundle can be securely installed in the shroud and yet sufficient clearances provided between the bundle and shroud to allow for radial and longitudinal temperature expansion without incurring undesirable stresses on either the bundle or shroud.

According to another aspect of the present invention, cooperation between a shell and a shroud at least partially within the shell is established by at least one boss extending radially outward from the exterior surface of the shroud and a channel on the inside of the shell at least partially closed at its boss receiving end and having a longitudinal path. In this aspect of the invention, a shroud can be securely installed in a heat exchanger shell with minimal interruption of fluid flow between the shell and the shroud and yet sufficient clearances provided between the shroud and the shell to allow for radial and longitudinal temperature expansion without incurring undesirable stresses on either the shell or the shroud.

According to another aspect of the present invention, a tube bundle comprising a tube sheet with a plurality of parallel tubes affixed thereto is supported by a cage of rod baffles having at least one apertured baffle substantially partitioning the tube sheet from the series of rod baffles. In this aspect, cooperation between the baffle cage and apertured baffle greatly facilitates providing the bundle with an apertured baffle to improve flow distribution and minimize the accumulation of undesirable deposits on the tube sheet.

According to another aspect of the invention, a shroud is installed in a heat exchanger shell by passing a boss extending radially outward from the exterior surface of the shroud through a circumferential channel affixed to the interior surface of the heat exchanger shell, and then passing the boss along a longitudinal channel to a resting point at one end of the longitudinal channel. In this aspect, the invention provides a simple and inexpensive method for fabricating a sturdy shell-shroud assembly which has good tolerance for radial and longitudinal temperature expansion and contraction.

In another aspect of the present invention, a tube bundle is installed in a heat exchanger shroud by aligning a guide rail on the bundle with an alignment guide on the inside of the shroud and positioning the bundle within the shroud. In this aspect, the invention provides a simple and inexpensive method for fabricating a sturdy shroudbundle assembly which has good tolerance for radial and longitudinal temperature expansion and contraction.

DETAILED DESCRIPTION OF THE INVENTION

Figure 1:
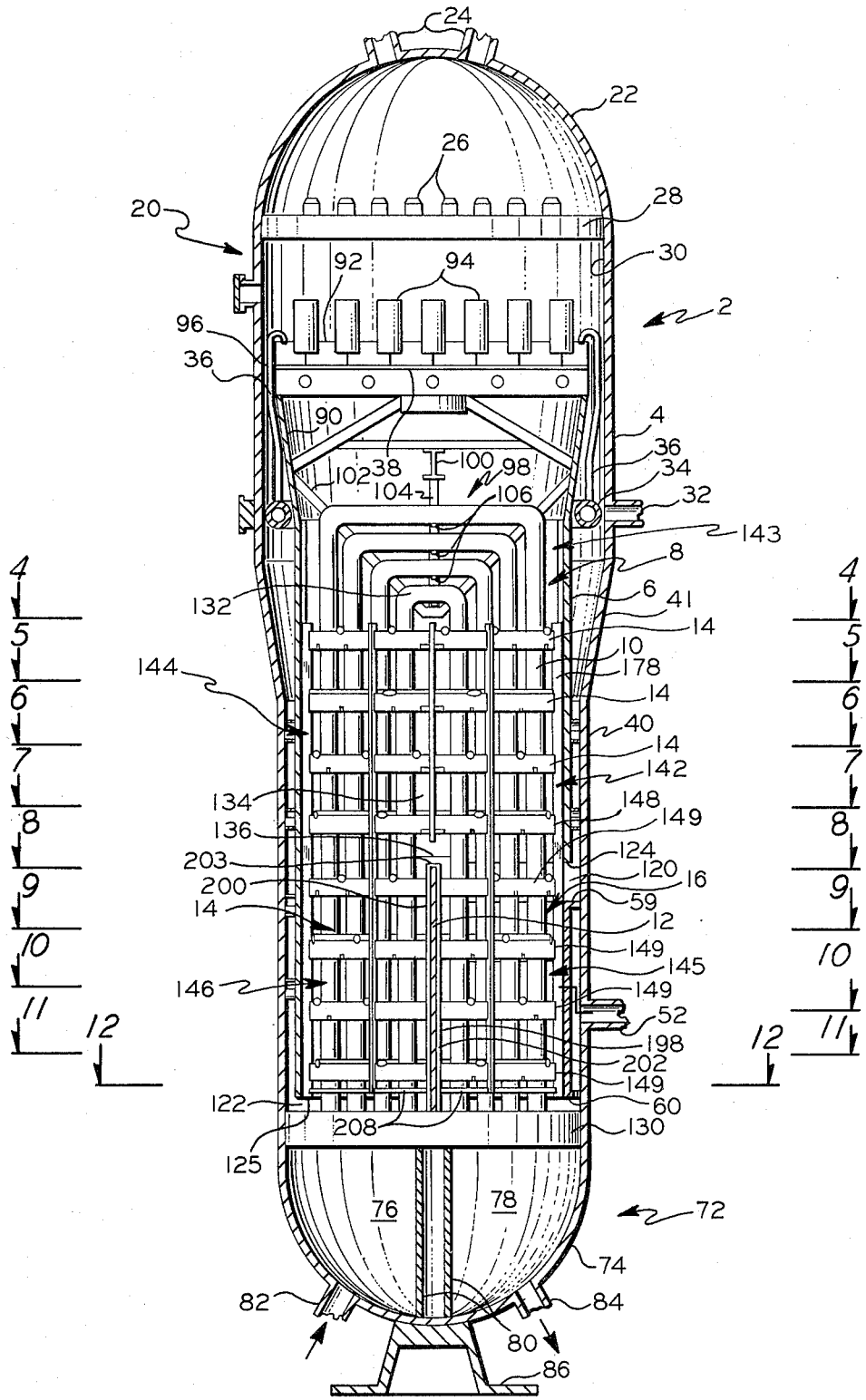
FIG. 1 illustrates certain features of one embodiment of the invention from a perspective view in partial cross section.

With reference to FIG. 1, a heat exchanger designated generally by the reference numeral 2 comprises an exterior pressure shell 4, seen in cross section, a shroud 6 mounted within the shell 4 and shown in cross section, and a tube bundle, shown in perspective and designated generally by the reference numeral 8, mounted within the shroud. As illustrated, the tube bundle 8 comprises a plurality of tubes 10 which have been bent through an angle of 180° intermediate their ends. A partition plate 12 partially separates a hot leg 14 of the tube bundle 8 from a cool leg 16 of the bundle.

An upper portion 20 of the pressure shell 4 exhibits a generally circular section across its longitudinal axis. The upper portion 20 is closed by a bonnet 22 which has a generally hemispherically concave interior surface and is equipped with ports 24 therethrough for exit of steam. Steam dryers 26 are mounted on a deck 28 which is affixed to a cylindrical interior surface 30 of pressure shell 4 in its upper portion 20. The deck 28 forms a partition across the flow passage defined by the interior surface 30 of the pressure shell 4. A port 32 is provided through the cylindrical side wall of upper portion 20 of shell 4 for the inlet of auxiliary shell side feed water. Auxiliary shell side feed water introduced through the port 32 by a line not shown and is distributed by a circular tubular header 34 encircling the shroud 6 and vertical stand pipes 36 which communicate with header 34 and empty onto a steam dryer deck 38 affixed to and forming a partition across the upper end of shroud 6.

Figure 2:
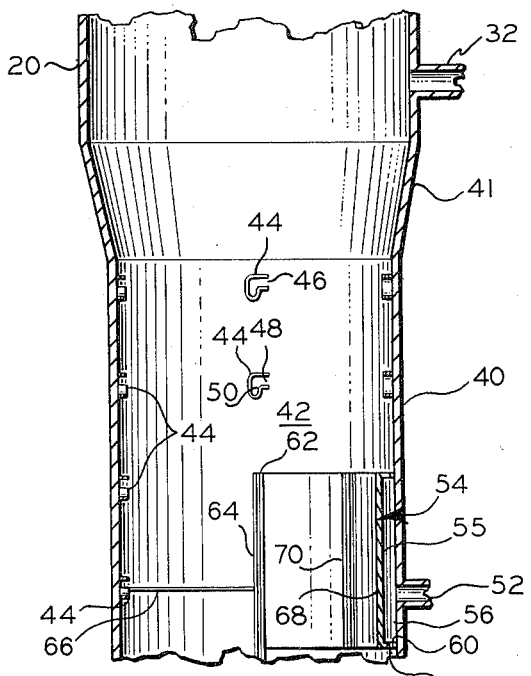
FIG. 2 is a cross-sectional view illustrating certain features of one embodiment of the present invention.

A middle portion 40 of the pressure shell 4 has a smaller diameter than the upper portion and is separated therefrom by a tapered section 41 in the shell. As best shown by FIG. 2, a generally cylindrical interior surface 42 of the middle portion 40 of the pressure shell 4 is equipped with at least one means 44 for defining a channel 46 on the generally cylindrical interior surface 42 of shell 4. As illustrated, the channel 45 has a generally circumferential path portion 48 and a generally longitudinal path portion 50 with respect to the generally cylindrical interior surface 42 of the shell 4. The circumferential path portion 48 has a mouth opening to the interior surface of the shell at one end and opens into the longitudinal path portion 50 of the channel at the other end. The longitudinal path portion 50 is at least partially closed at each of its ends and has at least one of its ends removed from its communication with the circumferential path portion of channel 46. Preferably and as illustrated, means 44 is a wall which defines a generally "L"-shaped channel between portions of the wall with one leg of the L extending partially circumferentially around the interior surface 42 of the shell 4 and the other leg of the L extending partially longitudinally along the generally cylindrical interior surface 42 of the shell 4. In this embodiment, the outside end of the circumferential leg of the L-shaped channel is unclosed and forms a path from the cylindrical surface 42 to the channel 46. Preferably, the generally cylindrical interior surface 42 of the shell 4 is equipped with a plurality of channel forming means 44 arranged on the generally cylindrical interior surface 42 of the shell at certain longitudinal intervals, the means 44 at each interval being separated by right angles.

Figure 8:
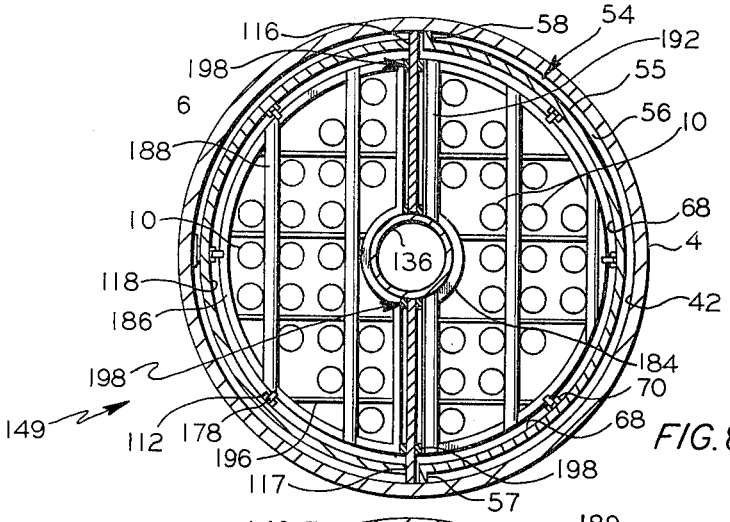
FIG. 8 is a plan representation illustrating certain features of FIG. 1 taken along the indicated lines of FIG. 1.
Figure 10:
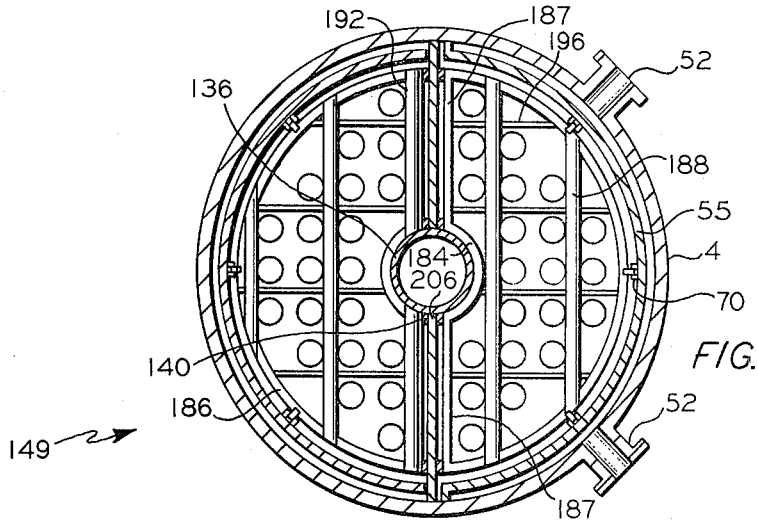
FIG. 10 is a plan view illustrating certain features of FIG. 1 as seen along the indicated lines of FIG. 1.
Figure 12:
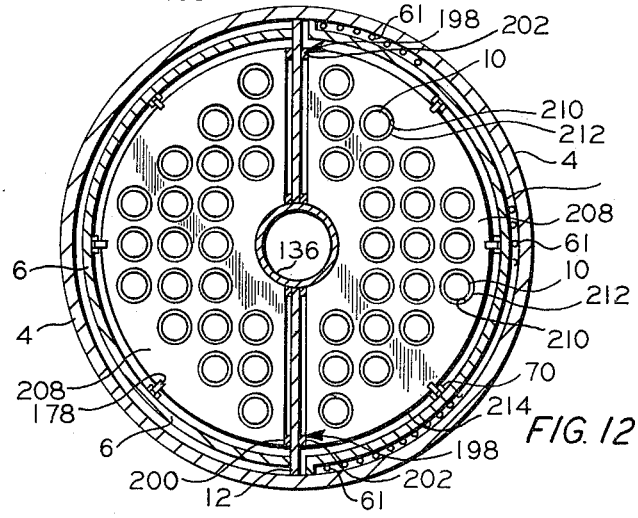
FIG. 12 is a plan view illustrating certain features of FIG. 1 as seen along the indicated lines of FIG. 1.
Figure 14:
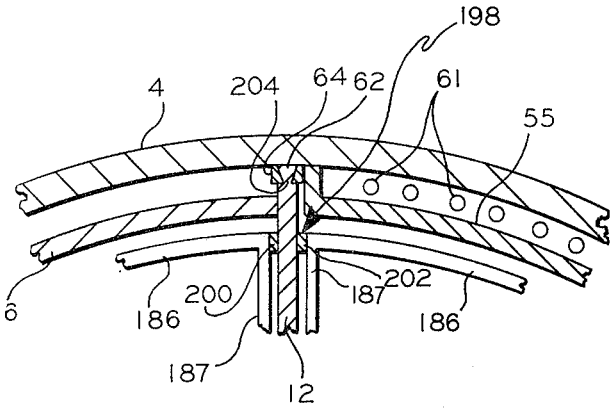
FIG. 14 is an enlarged plan fragment of a portion of the apparatus as seen in FIG. 10.

The middle portion 40 of the pressure shell 4 is further provided with at least one port 52 for inlet of the main shell side feed water stream. The port 52 establishes communication between the exterior of the shell 4 and a feed water box 54 which is affixed to the generally cylindrical interior surface 42 of the shell 4 at the lower end of the middle portion 40. The feed water box 54 (see also FIG. 8) comprises an inside wall 55 in juxtaposed relationship with a portion of the generally cylindrical surface 42 of the shell 4. An annularly shaped volume 56 having a rectangular cross section when cut longitudinally is defined between wall 55 and surface 42, with the arc of the annulus being approximately 175°. Volume 56 is closed along its sides by a pair of longitudinally extending walls 57 and 58 which link the interior surface 42 to wall 55. The volume 56 is closed along its ends by an upper end wall 59 and a lower end wall 60. End walls 59 and 60 exhibit an annular segmental shape, defined herein as the shape of the annulus of a segment of a circle. Wall 60 has a plurality of apertures 61 (see also FIGS. 12 and 14) therethrough, establishing a flow passage from the feed water box to the shell side of the heat exchanger. Feed water box 54 functions as a preheater for feed water introduced into the heat exchanger 2 via at least one port 52. Preferably and as illustrated, a pair of opposed ports 52 (see FIG. 10) are utilized for the introduction of a pair of normally opposed feed water streams into the feed water box. The interior surface of the middle portion 40 of the shell is further provided with a pair of opposed longitudinally extending mortises 62 defined by a pair of means 64 for defining a mortise. The means 64 are affixed to the interior surface of middle portion 40 of the shell outside of the feed water box 54 and adjacent the longitudinally extending walls 57 and 58 and are separated by an angle of about 180°.

The generally cylindrical interior surface 42 of the middle portion 40 of the pressure shell 4 is preferably further provided with at least one flange 66 extending circumferentially around a portion of the interior surface 42 of shell 4 thus partially forming an annulus. The flange 66 is preferably of about the same height extending radially inward from the interior surface of the shell 4 as the lower portion of the wall of means 44 defining channel 46. The flange 66 is preferably integral with the channel forming means 44 located in the middle portion of the shell. Preferably, the flange 66 is affixed to the wall 44 so that the wall of the circumferential path portion 48 of the channel which is adjacent the longitudinal path portion 50 of the channel is lengthened; i.e., the circumferentially extending inside wall of the L-shaped channel is lengthened, to form a circumferentially extending lip. Preferably, the channel forming means 44 lowermost in the shell 2 is provided with the circumferentially extending lip.

Preferably, a radially inward facing surface 68 of the inside wall 55 of the feed water box 54 is partially cylindrical in shape and faces the longitudinal axis of the apparatus 2. At least one alignment guide 70 extends longitudinally along the inside surface 68 of the inside wall 55 of the feed water box 54. Preferably, the alignment guide comprises a bar or pair of bars projecting radially inward from the inside wall 55 of the feed water box 54.

Again referring to FIG. 1, a lower portion 72 of the shell 4 comprises a hollow bonnet 74, preferably having a generally hemispherically concave inside surface and divided into a primarily fluid inlet half 76 and a primary fluid outlet half 78 by a partition plate 80. A nozzle 82 communicates with the inlet half 76 for introduction of heating fluid. A nozzle 84 communicates with outlet half 78 for outlet of heating fluid. A suitable support base 86 is affixed to the exterior surface of bonnet 74 in alignment with the longitudinal axis of the apparatus 2.

Figure 3:
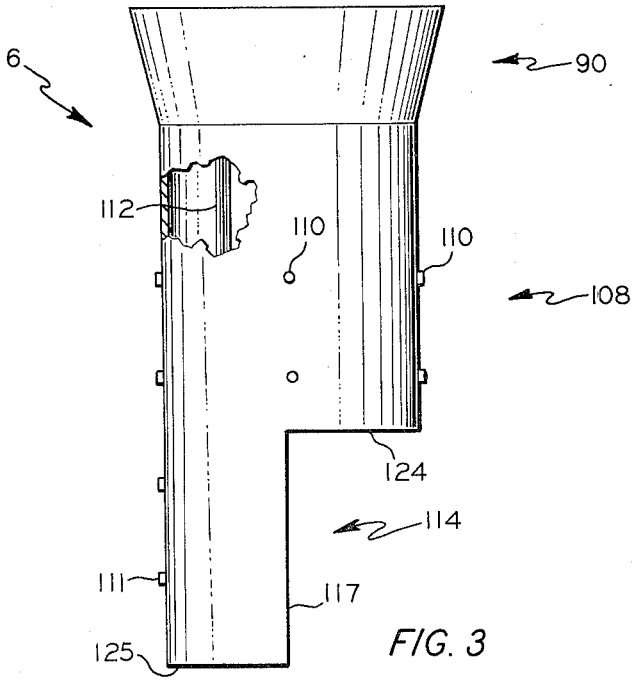
FIG. 3 is a perspective view illustrating certain features of one embodiment of the present invention.

Referring to FIGS. 1 and 3, the shroud 6 is concentrically arranged within the pressure shell 4. An upper portion 90 of the shroud 6 is concentrically arranged within the upper portion 20 of the shell 4 and is flared outwardly to a larger diameter than the remainder of the shroud. The upper portion 90 of the shroud 6 is generally frustoconical in shape. The steam dryer deck 38 forms a partition across the upper end of the upper portion 90 of the shroud 6. Steam water separators 94 are affixed to the deck 38 as is well known to those skilled in the art. An annular dam 92 having height in the longitudinal direction is circumferentially arranged around the edge of the deck 38. Water is separated from the steam produced during operation of the present apparatus by steam water separators 94 which are affixed to the deck 38. The separated liquid, and auxiliary feed water which is introduced onto the deck via vertical standpipes 36, forms a pool on the deck 38 which overflows across the top of annular dam 92 and down a longitudinally extending flow passage having an annular cross section 96 which is defined by the exterior surface of the shroud 6 and the interior surface 4 of the pressure shell.

The upper portion 90 of the shroud 6 is further equipped with tube support means designated generally by the numeral 98 to support the U-bend region of the tube bundle. As illustrated, at least one I-beam 100 is affixed across the interior of the upper portion 90 of shroud 6 as a chord. At least one downwardly extending V-shaped member, commonly called a bat-wing, 102, is affixed to the interior surface of the upper portion of the shroud and lies in a longitudinally extending plane which is perpendicular to the longitudinally extending plane of the I-beam. At least one vertical support strip 104 establishes cooperation between the I-beam 100 and the bat-wing 102. Horizontal support strips 106 are affixed to the vertical support strip 104 in planes which are at right angles to the plane of the bat-wing. When utilizing a tube bundle laid out on a square pitch arrangement, a plurality of bat-wings and vertical support strips extend between adjacent panels of tubes and prevent tube collision. The horizontal support strips extend between the horizontally extending panels of the horizontal tube portions in the "U"-bend region and prevent collision of the tubes of each panel. Preferably, the bat-wings, vertical support strips, and horizontal support strips fit loosely between the panels of tubes, to allow for temperature expansion.

Figure 13:
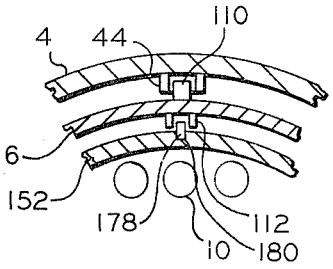
FIG. 13 is an enlarged plan fragment of a portion of the apparatus positioned between lines 5 and 6 of FIG. 1.

Referring to FIG. 3, a middle portion 108 of the shroud 6 has a generally cylindrical exterior surface to be positioned in juxtaposed relationship with the interior surface of the shell and a generally cylindrical interior surface. The middle portion 108 of the shroud 6 is provided with at least one boss 110 extending radially outward from the generally cylindrical exterior surface of the shroud. The boss 110 is received by the channel 46 of the pressure shell 4 in its longitudinal path portion 50 adjacent the end of the longitudinal path portion 50 spaced apart from the opening from the circumferential path portion 48 of the channel 46. Preferably, sufficient distance exists between the outside edge of boss 110 and the generally cylindrical surface 42 of the pressure shell 4, and also between the inside edge of the channel forming means 44 and the generally cylindrical exterior surface of shroud 6 to allow for radial expansion and/or contraction (due to temperature changes) between the shroud 6 and the shell 4. This is best shown in FIG. 13. Preferably, the middle portion 108 of the shroud 6 is provided with a plurality of bosses 110 on its generally cylindrical exterior surface, with the bosses 110 being arranged so as to be received by the channels 46 on the interior surface of the pressure shell 4, one boss per channel. The channels 46 thus function as boss receiving means. The generally cylindrical interior surface of the middle portion 108 of shroud 6 is provided with at least one longitudinally extending means for guiding alignment 112. Preferably, the shroud is equipped with at least three means 112, usually 4, as illustrated. Preferably, the alignment guide 112 is a rail or pair of parallel rails defining a groove. The rails have a dimension which extends radially inward from the interior surface of the shroud 6 and present protuberances which extend longitudinally along the generally cylindrical interior surface of the middle portion 108 of the shroud 6.

Viewing FIGS. 1, 2 and 3, a lower portion of the shroud 114 is defined by an arcuate section across the longitudinal axis of the shroud. Preferably, the arc spans an angle of about 175°. Longitudinal edges 116 and 117 of the lower portion 114 face toward the longitudinally extending confining walls 57 and 58 (see FIG. 8) of the feed water box 54. An inside surface 118 (see FIG. 8) of the lower portion 114 of shroud 6 faces the longitudinal axis of the heat exchanger 2. The longitudinal flow passage having an annular cross section defined between the exterior surface of shroud 6 and the interior surface of pressure shell 4 empties into the volume defined by the interior surface of shroud 6 through circumferentially extending slots 120 and 122. Slot 120 is defined between a lower arcuate edge 124 of the middle portion 108 of shroud 6 and the upper circumferentially extending annular end wall 59 of the feed water box 54. The circumferentially extending slot 122 is defined between a lower arcuate edge 125 of the lower portion 114 of shroud 6 and a tube sheet 130.

The tube bundle 8 is concentrically disposed in the shroud 6. The tube bundle 8 comprises a plurality of tubes arranged in at least a first plurality of parallel tube rows and a second plurality of parallel tube rows. A tube row is sometimes referred to as a panel of tubes. Lanes are defined between the tube rows or panels. Each tube 10 is affixed by at least one of its ends to an aperture through the tube sheet 130. As illustrated, each of the tubes is affixed by each of its ends to an aperture through the tube sheet 130. The tubes are laid out in a 90° square pitch array, and each tube 10 of the bundle 8 bent through a 180° directional change at the end of the bundle 8 which is opposite tube sheet 130. The tube bundle 8 as illustrated is a bundle of U-shaped tubes 10. Because there is a limit to which the innermost tube of the bundle, illustrated in FIG. 1 as tube 132, can be bent, the tube bundle 8 has a void panel shaped volume 134 extending across its diameter. In this context, void means characterized by the absence of tubes 10.

Figure 4:
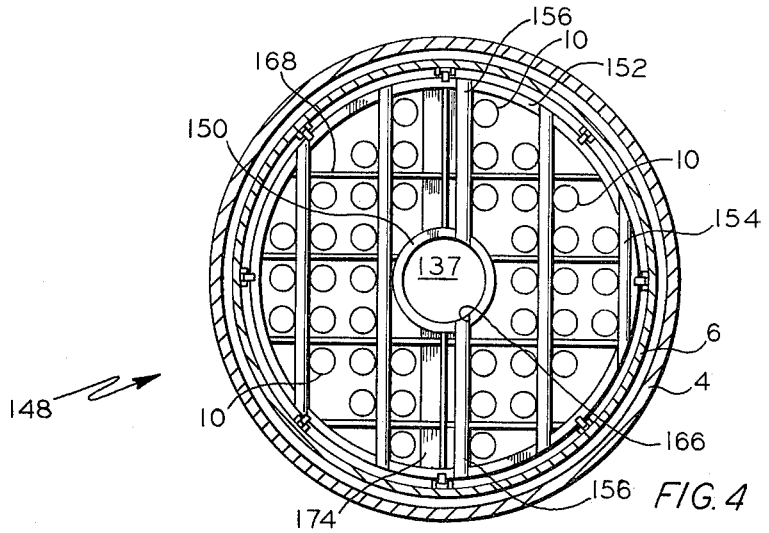
FIG. 4 is a plan representation illustrating certain features of one embodiment of the present invention as seen along the indicated lines of FIG. 1.
Figure 5:
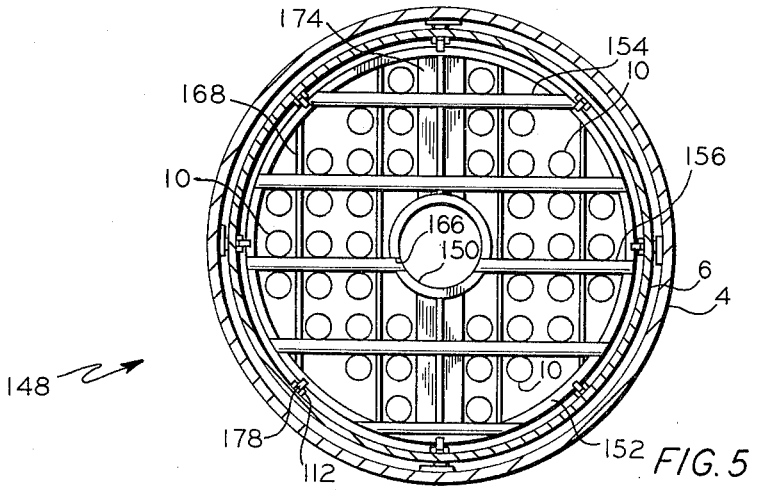
FIG. 5 is a plan representation illustrating certain features of FIG. 1 as seen along the indicated lines of FIG. 1.
Figure 6:
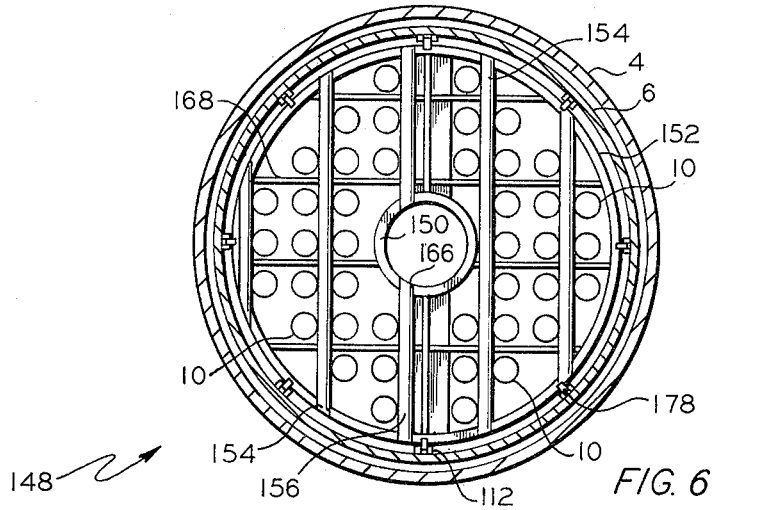
FIG. 6 is a plan representation illustrating certain features of FIG. 1 as seen along the indicated lines of FIG. 1.
Figure 7:
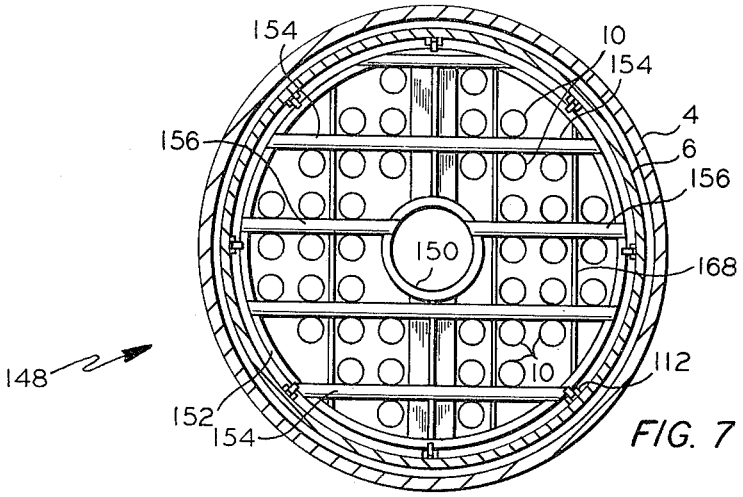
FIG. 7 is a plan representation illustrating certain features of FIG. 1 taken along the indicated lines of FIG. 1.

As illustrated, a central support cylinder 136 extends from the tube sheet 130 along the longitudinal axis of the tube bundle for at least a portion of its length. Because of the central support cylinder 136, the tube bundle 8 is also provided with a cylindrically shaped void volume 137 (see FIG. 4) along its longitudinal axis for at least a portion of its length to provide for passage of the central support cylinder 136. As before, by a void volume is meant a portion of the tube bundle characterized by the absence of tubes. The void panel volume 134 extending across the diameter of the tube bundle 8 intersects with the cylindrical void 137 which extends along the longitudinal axis of the bundle. The central support cylinder 136 is provided with radially outwardly opposed longitudinally extending mortises 140 (see FIG. 9) which are aligned with the panel void 134 extending transversely through the tube bundle 8.

Support for the tube bundle is provided by a baffle cage 142. Generally, the baffle cage 142 comprises a series of at least two rod baffles in axial alignment and usually arranged in parallel planes normal to the longitudinal axis of the tube bundle. However, for some applications, the baffles can be arranged in planes which are inclined to the longitudinal axis of the tube bundle. Cooperation between the different rod baffles of the series is provided by at least one longitudinal support member generally parallel to the longitudinal axis of the bundle which establishes cooperation between adjacent baffles.

As illustrated, the tube bundle is divided into a U-bend region 143, a vaporization region 144 and an economizer region 145 and a lower leg vaporization region 146. The portion of the tubes 10 passing through the U-bend region 143 is supported and collision between the tubes prevented by the means 98 previously described. Suitable baffles are provided in the vaporizer region 144, the economizer region 145 and the lower leg vaporization region 146 of the bundle to support the tubes 10. As illustrated, the baffles in vaporizor region 144 and rod baffles 148 (FIGS. 4, 5, 6 and 7). The baffles in the economizer region 145 and lower leg vaporization region 146 are rod baffles 149 (FIGS. 8, 9, 10 and 11).

Generally (see FIGS. 4, 5, 6 and 7), each rod baffle comprises an inner member 150 having an arc shaped portion and an outer member 152 having an arc shaped portion. The arc shaped portions of inner member 150 and outer member 152 are in a juxtaposed relationship, are concentrically arranged, and lie in a common plane. In the rod baffles 148 and in a portion of the baffles 149 (see FIGS. 8 and 10 at 188), at least one first rod 154 is affixed across the arc shaped portion of the outer member 152 as a chord. At least one second rod 156 which is parallel to the first rod 154 establishes cooperation between the arc shaped portion of the outer member 152 and the arc shaped portion of the inner member 150. Preferably, at least one pair of second rods 156 are affixed to the outer member 152 as an interrupted chord, with the discontinuity being defined between the affixation points of the second rods 156 to the arc shaped portion of the inner member 150. Preferably, pluralities of first and second rods are affixed to at least one of the support members to form a grate.

The rods 154 and 156 pass through a portion of the lanes between the parallel panels of tubes. Each rod touches and supports each tube in the two panels of tubes between which it passes so that the rods in one baffle support a portion of the tubes in the bundle. Preferably, the rods of each baffle pass through alternating lanes defined by the parallel panels of tubes. By passing the rods through alternating lanes between tube panels, and by passing the rods between different tube panels in different baffles, each tube of the bundle can be provided with radial support by four rods, one from each of four different baffles. The four baffles in this preferred embodiment which are required to provide the tubes of the bundle with radial support are referred to as a "baffle set" and are shown best by FIGS. 4–7.

Because there is only point contact between the rod and the tube, rod baffle support of the tube bundle substantially reduces the risk of dryout at the tube/support interface. Because each tube of the bundle is provided with zero clearance radial support, the tube bundle is very sturdy and the danger of damage caused by mechanical vibrations is very low. Because fluid flowing perpendicular to the rods experiences turbulence and forms vortex streets as it flows around the rods, heat transfer in the rod baffled tube bundle is very good. Because the rods of the baffles support the tubes with little obstruction of the flow of shell side fluid, pressure drop is low, the velocity of shell side fluid is high, and the probability of crud accumulations or localized vaporization or hammering is substantially reduced. Rod baffle support of the tube bundle thus improves the corrosion resistance of the bundle, improves the structural integrity of the bundle, improves the heat transfer capability of the bundle, and, as will be discussed later, decreases the cost of manufacturing the bundle, over tube bundles employing conventional egg crate baffles or plate baffles.

Figure 16:
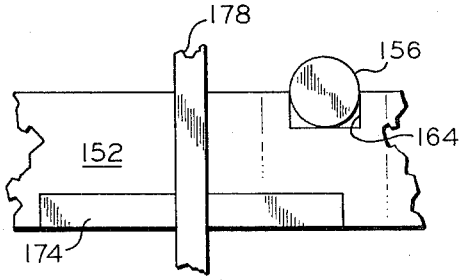
FIG. 16 is an enlarged perspective fragmented view of a portion of the apparatus as seen in FIG. 15 taken along the indicated lines.
Figure 20:
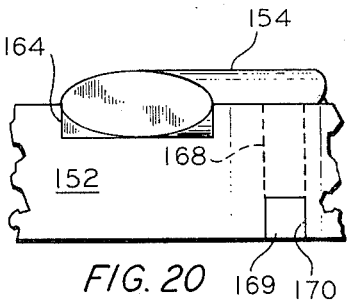
FIG. 20 is an enlarged perspective fragmented view of a portion of the apparatus as seen in FIG. 15.
Figure 17:
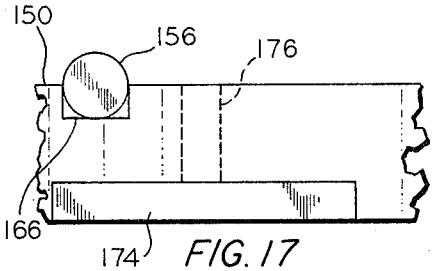
FIG. 17 is an enlarged perspective fragmented view of a portion of the apparatus as seen in FIG. 15 taken along the indicated lines.
Figure 19:
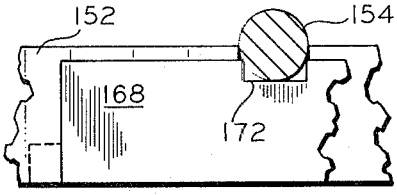
FIG. 19 is an enlarged perspective fragmented view of a portion of the apparatus as seen in FIG. 15 taken along the indicated lines.
Figure 18:
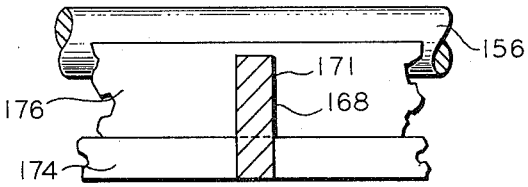
FIG. 18 is an enlarged perspective fragmented view of a portion of the apparatus as seen in FIG. 15 along the indicated lines.

As illustrated in FIGS. 4–7, the baffles in the vaporization region 144 of bundle 8 comprise an inner ring 150 and an outer ring 152. The inner rings and outer rings are generally circular in shape. The outer ring encircles the bundle and defines its outer tube limit. The inner ring 150 is in the central cylindrical void 137 of the bundle 8. At least one rod 154 is affixed across the outer ring 152 as a chord. At least one rod 156 establishes cooperation between the outer ring 152 and the inner ring 150 and is parallel to the rod 154. Preferably, the rods 154 and 156 are set in grooves 164 (FIGS. 16 and 20) on the outer ring 152 and rods 156 are set in grooves 166 in the inner ring 150 (FIG. 17). The groove for receiving the rod in the ring is in an end surface of the ring. As used herein, the term "end of the ring" is intended to designate an annular surface facing in a longitudinal direction. The rods are at least partially recessed in the grooves and are affixed to the ring, for example, by welds. The vaporizer section baffles as shown are equipped with at least one optional rod support strip 168 for contacting and supporting at least a portion of the rods. The rod support strip 168 is affixed to at least the outer ring 152 as a chord and extends at least partially across the area scribed by outer ring 152 at preferably a right angle to the rods. The rod support strip further minimizes the risk of occurrence of vibratory damage. The dimension of each rod support strip 168 extending parallel to the longitudinal axis of outer ring 152, as shown clearly in FIG. 19 is about the same as or slightly less than the dimension of outer ring 152 which extends parallel to its longitudinal axis. The dimension of the rod support strip 168 orthogonal to its longest dimension and its dimension parallel to the longitudinal axis of the outer ring 152 is about the same as or less than the diameters of the rods. Preferably, the rod support strip 168 is at least partially affixed to the ends of the inner rings 150 and outer rings 152 opposite the ends of the rings which support the rods 154 and 156. The rod support strip 168 as shown is set in a groove 170 cut into the end of the ring opposite that end of the ring which supports the rods, forming a rabbet joint with the outer ring 152. A rectangular portion is removed from one corner of the rod strip 168 to form a tongue 169 on the closest adjacent corner which is affixed in groove 170, for example, by welding. The edge of the rod support strip 168 which is adjacent to the rods of the baffle is provided with transverse rod support grooves 172. The rods lie in the grooves 172 for support, and can be affixed thereto, for example, by welds.

Figure 15:
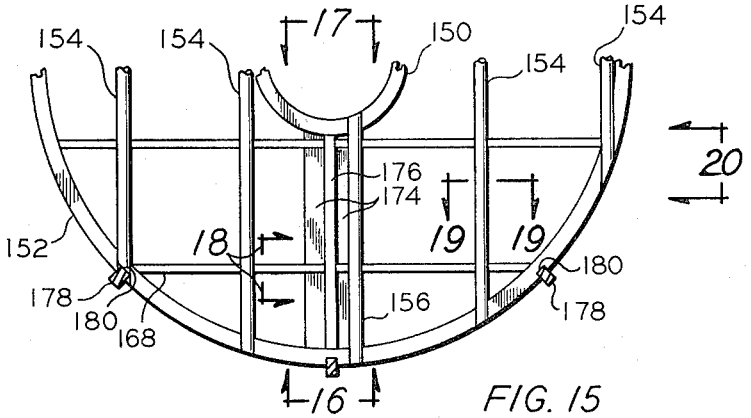
FIG. 15 is an enlarged plan fragment illustrating in greater detail certain of the features of the present invention as shown by FIGS. 4–11.

The vaporizer region baffles can also be optionally provided with at least one plate baffle 174 to obstruct the flow of fluid through the panel-shaped void 134 which separates the legs of the tube bundle. Plate baffles 174 further improve the heat transfer capabilities of the bundle. As shown, each vaporizer region baffle comprises at least one plate baffle 174 to partially obstruct the void panel volume 134 across the diameter of the tube bundle and prevent channeling of shell fluid through the panel volume 134. The plate baffle 174 extends at least partially across the diameter of outer ring 152 and is affixed by at least one of its ends to the outer ring 152. Preferably and as illustrated (see FIG. 15), the plate baffle 174 is affixed by the other of its ends to inner ring 150. As illustrated, each vaporizer region baffle is provided with a pair of plate baffles 174 in longitudinal alignment which cooperate with each of the inner ring 150 and the outer ring 152 and are suspended between the rings along an interrupted diametrical chord across the outer ring. The chord is interrupted by the inner ring 150. The plates lie in or parallel to the plane of the baffle, usually within the plane of the ring and parallel to the plane defined by the rods. Preferably, each plate baffle 174 is substantially imperforate and is of sufficient width to at least partially form a partition across the void panel volume 134 between the legs of the tube bundle. The dimension of the plate baffle along the diameter of the outer ring is substantially larger than its dimension as measured perpendicular to its diameter. To provide reinforcement for the plate baffles 174, a plate baffle support strip 176 is affixed along one of its long narrow edges to the plate baffle 174. When utilized, the plate baffle support strip 176 is affixed to at least the outer ring, for example, by welds. The plate baffle support strip has a dimension parallel to the longitudinal axis of the outer ring 152 which is about the same as or less than the longitudinal dimension of each ring 152. For rod baffles in which the plate baffle support strip 176 and the rods cross at right angles, the long narrow edge of the support strip 176 adjacent the rods can be provided with transverse grooves to touch and support the rods. The rods can be affixed to the grooves in the plate baffle support strips, for example, by welds. In baffles in which the plate baffle support strip is parallel to the rods, the rod support strips 168 can extend from the outer ring 152 to an affixation point on the plate baffle 174 abutting the plate baffle support strip 176. A notch can be cut into one corner of the rod support strip to provide a tongue 171 (see FIG. 10) which rests on the baffle plate 174, intersecting it at a right angle. Preferably and as illustrated, the baffle plate 174 is affixed to suitable grooves in each of the inner ring and the outer ring, and the baffle plate support strip 176 abuts against the generally cylindrical interior surface of the outer ring 152 and the generally cylindrical exterior surface of inner ring 150 and has a height slightly less than that of the inner or outer ring. In this embodiment, the outer surface of the plate baffle 174 is flush with the plane of the end of outer ring 152.

Cooperation is established between the vaporizor region baffles by at least one guide rail 178 which is parallel to the longitudinal axis about which the baffles are arranged in parallel planes and which is affixed to the outer ring members 152. The outer ring members 152 at least partially encircle the exterior of the tube bundle and are spaced longitudinally along the tube bundle. The guide rail 178 is generally parallel to the longitudinal axis of the tube bundle and at right angles to the planes of the rings. Preferably, the guide rail 178 is fastened to each outer ring 152 in a longitudinally extending traverse groove 180 cut in the generally cylindrical exterior surface of outer ring 152 and projects out of the groove radially away from the outer cylindrical surface of the ring. The guide rail 178 thus presents a radial protuberance extending longitudinally along the exterior of the tube bundle. As illustrated, the guide rail 178 is slidably engaged with the groove in alignment guide 112 on the generally cylindrical interior surface of shroud 6. Preferably and as illustrated, the guide rail 178 is also slidably engaged with alignment guide 70 (see FIG. 2) on the inside wall of feed water box 59. Preferably, the tube bundle is provided with at least 3 guide rails 178. Preferably, sufficient clearance exists between the interior surface of shroud 6 and the outermost surface of guide rail 178, and the innermost surface of alignment guide 112 and the outermost surface of ring 152 to allow for radial temperature expansion and/or contraction, as best shown in FIG. 13.

In the economizer region 145 and the lower leg vaporization region 146 of the tube bundle 8, best shown in FIGS. 8–11, positive tube support is provided by baffles 149. Each baffle 149 comprises an inner arc-shaped member 184 and an outer arc-shaped member 186, the inner and outer arc-shaped members being in juxtaposed relationship with the ends of the arc-shaped members being aligned with respect to each other. Generally, the arc-shaped members each span an angle of from about 150°–180°. Preferably, the arc-shaped members are semi-circular in shape but span an angle of less than 180°, for example, about 175°. At least one elongated support member 187 at least partially crosses the opening of the outer arc-shaped member as a chord and establishes cooperation between the ends of the inner arc 184 and the ends of the outer arc 186 as an interrupted partial chord partially crossing the opening of the outer arc. As shown, a pair of elongated members 187 in longitudinal alignment cooperate with an inner arc 184 to form an outer arc closure member. The outer arcs, elongated support members, and inner arcs of longitudinally adjacent baffles are in a juxtaposed relationship. In the embodiment shown in FIGS. 8 and 10, the area circumscribed by the rod support members 184, 186 and 187 can be described as the annulus of a segment of a circle. A portion of the baffles 149 is provided with at least one first rod 188 is affixed to the outer arc-shaped member 186 as a chord. Preferably, the rod 188 is at least partially recessed into one longitudinal end of outer arc-shaped member 186 in a suitable groove. At least one second rod 192 is provided parallel to the first rod 188 and is affixed to each of the inner arc-shaped members 184 and the outer arc-shaped member 186. Preferably, one end of the second rod 192 is set into a groove in one longitudinal end of outer arc 186 and the other end of second rod 192 is set in a groove in one longitudinal end of inner arc 184. Preferably, a plurality of first rods and a plurality of second rods are employed, so that the rods pass through alternating lanes defined by the panels of tubes. Baffle sets are employed to provide radial support for each tube of in this portion of the bundle.

Figure 9:
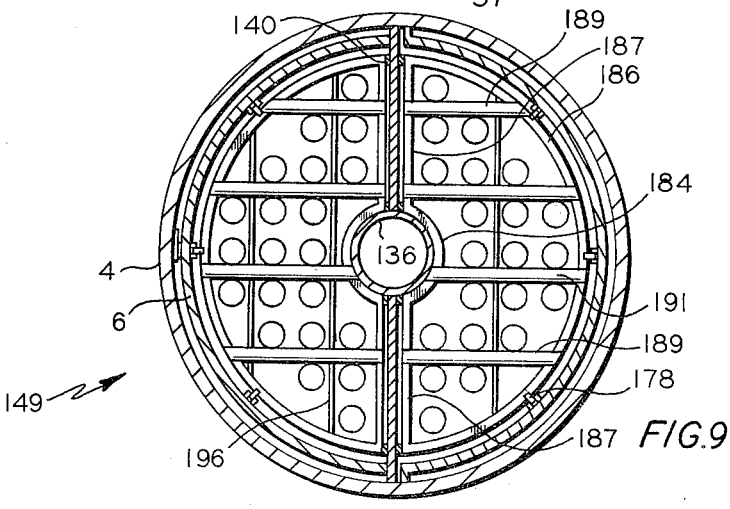
FIG. 9 is a plan representation illustrating certain features of FIG. 1 as seen along the indicated lines of FIG. 1.
Figure 11:
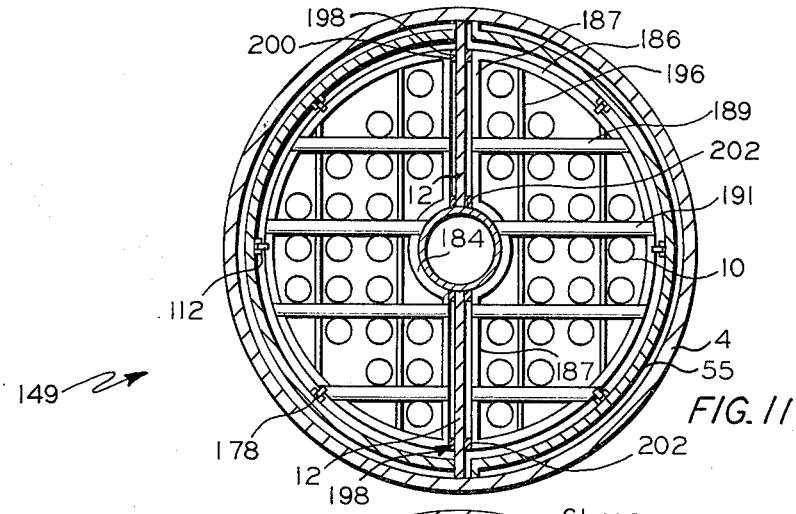
FIG. 11 is a plan view illustrating certain features of FIG. 1 as seen along the indicated lines of FIG. 1.

Certain of the baffles 149, as shown in FIGS. 9 and 11, are provided with rods affixed to the outer arc-shaped member 186 as partial chords. As illustrated, at least one first rod 189 is affixed by one of its ends to the outer arc-shaped member 186 and by the other of its ends to one of the elongated rod support members 187. Preferably, a plurality of parallel rods extend from the outer arc-shaped member 186 to the elongated support member 187. Generally, the rods are affixed to the elongate support member at about a right angle, as measured between the longitudinal dimensions of the elongate support member and the rods. The inner arc-shaped member 184, smaller than the outer arc-shaped member 186, is affixed to the inner ends of the elongate support members 187 and at least one additional rod 191, parallel to the at least one rod 189 is affixed to each of the inner arc-shaped member 184 and the outer arc-shaped member 186 as a partial chord with respect to the outer arc-shaped member 186. As before, the inner arc-shaped member 184 is in juxtaposed relationship with the outer arc-shaped member 186. Generally, the rods 189 and 191 are affixed in suitable transverse groove in the ends of the support members which face in the longitudinal direction.

Similar to the vaporization section baffles, the economizer section baffles and lower leg vaporization baffles can be provided with suitable rod support strips 196. Each rod support strip 196 can be affixed to the outer arc 186, or the outer arc 186 and the inner arc 184, or the outer arc 186 and the elongated support member 194 via grooves in the support member and affixation to the support strip via a rabbet joint. Preferably, the rod support strips at least partially cross the baffle at about a right angle with respect to the rods. The edge of the rod support strip adjacent the rods is grooved as for the support strips in the vaporizer section so as to contact and support the rods.

In addition to at least one annularly segmentally-shaped rod baffle, the baffle cage for the economizer region 145 and lower leg vaporization region 146 of the tube bundle 8 comprises at least one support member 198 (FIG. 1) having at least one planar surface. As illustrated, the at least one support member 198 comprises (see FIG. 14 also) at least one channel bracket comprising a first rectangular plate 200, a second generally rectangular plate 202 parallel to the first plate and a separating plate 203 (see FIG. 1) normal to the first plate and the second plate so as to form a support member having a "U"-shaped cross section with a first and a second oppositely facing generally planar surfaces defined on the outsides of the legs of the "U". The generally rectangular surfaces have a generally rectangular shape. Bracket 198 is affixed to a segment-shaped rod baffle 149 with the first generally planar surface of the bracket preferably positioned normally to the plane of the baffle and parallel to the rods of a portion of the baffles. Outer arc-shaped member 186 forms an arc over at least a portion of the width of the first generally planar surface 200 of bracket 198. Although, as shown, the baffle 149 is affixed to the bracket 198 via the side of the elongated support member 187, it is contemplated that affixation of the baffle 149 to the bracket 198 can be via the ends of the inner and outer arc-shaped members. Preferably and as illustrated, two pair of brackets 198 are employed in the apparatus of the present invention. A series of generally segmental shaped baffles 149 are affixed across the width of the first generally planar surface 200 of each bracket 198 in parallel planes. A series of baffles 149 are likewise affixed to the second generally planar surface 202 of each bracket 198 in a series of parallel planes. Preferably the baffles 149 affixed to the second generally planar surface 202 of bracket 198 are in the same plane as the baffles 149 affixed to the first generally planar surface 200 of the bracket 198. Cooperation between the baffles in the economizer and lower leg vaporization regions of the bundle can be further provided via at least one guide rail 178 extending longitudinally between the outer arc-shaped members and cooperating with the alignment guides of the shroud or preheater box as previously described.

The tube sheet 130 (see FIG. 1) is affixed to the interior surface of shell 4 for example, by welds and separates the middle portion 40 of the shell from the lower portion 72. The tube sheet 130 is at least partially supported by partition plate 80. The center support cylinder 136 extends longitudinally along the longitudinal axis of the tube bundle from the tube sheet 130 and is embraced by the inner arc-shaped members 184. Brackets 198 embrace a pair of aligned partition plates 12 in the partition void volume 134 crossing the diameter of the tube bundle. Each partition plate 12 cooperates at one end via a tendon 204 (see FIG. 14) with the mortise 62 along the interior surface of shell 4. Each partition plate 12 at its other end cooperates via a tendon 206 (see FIG. 10) with the mortise 140 of the central support cylinder 136.

Preferably, at least one apertured baffle 208 (see FIG. 12) is provided at the lower end of the bundle 8 adjacent the tube sheet 130 and forms a partition at least partially across the tube bundle. The apertured baffle 208 is positioned intermediate the tube sheet 130 and the series of rod baffles. Preferably, a pair of apertured baffles 208 are provided which are integral with the baffle cage, each apertured baffle 208 being affixed to at least one longitudinal support member, which can be a guide rail 178, or a support member 198, or both. Each of the aperture baffles 208 forms a partition substantially across one leg of the tube bundle with at least substantially all of the tubes of each leg passing through an aperture, one tube per aperture. Generally, the apertured baffles 208 are segmental in shape. The pair of apertured baffles lie in a common plane and thus form a partition substantially across the tube bundle. Preferably, each apertured baffle has the shape of an annulus of a segment. Each of the apertured baffles 208 is provided with a plurality of apertures 210 to allow for passage of the tubes 10 of the tube bundle 8 therethrough and provide annularly-shaped flow passages 212 between the tubes and the walls of the apertures through the baffle for flow of shell side fluid through the apertured baffle 208. The aperture baffles insure substantially longitudinal flow of shell side fluid and reduce crud accumulations on the tube sheet. Cooperation between apertured baffles 208 and the baffles 149 of the economizer region 145 and lower leg vaporization region 146 of tube bundle 8 is provided via affixation of the baffles 208 to bracket 198. Additional cooperation can be provided via cooperation between an outer edge 214 of aperture baffle 208 with at least one guide rail 178.

FABRICATION

Generally, fabrication of the heat exchanger can be broken down into five broad steps. The first step involves the preparation of the components to form the rod baffles. The second involves the preparation of the components to form the rod baffle cage, and includes assembling the rod baffles. The third involves the preparation of the components to form the tube bundle, and includes assembling the rod baffles into the baffle cage. The fourth involves the preparation of the components to form the heat exchanger, and includes inserting the U tubes into the baffle cage to form the tube bundle. In the fifth step, the heat exchanger components are assembled to form the completed heat exchanger.

In the preferred embodiment, each rod baffle comprises an outer ring, an inner ring, rods, and rod support strips. Additionally, the vaporizer section baffles are equipped with a divider bypass plate, and the economizer section baffles are equipped with incomplete inner and outer rings and are affixed to a divider plate bracket. The initial step in the fabrication of individual rods baffles is that of cutting and rolling rectangular cross section bar stock to form the baffle rings and center support rings. After the ends of the rolled rings are welded, all baffle and center support rings are machines to a uniform inside diameter. Baffle rods, rod support strips, the inner/outer ring support bars for the annular segmental economizer section baffles, and the divider bypass plates for the vaporizer section baffles are next cut to the desired length.

The next step is the preparation of the baffle cage components. The rod baffles are assembled as follows. The outer ring and inner ring are concentrically arranged on the working surface and retained in position by suitable means. The 60 divider bypass plates are then diametrically affixed to the 30 vaporizer section baffles by welding. The 56 inner/outer ring support bars for the 14 pairs of economizer section rod baffles are welded to the inner and outer rings as parallel interrupted chords offset from the diameter sufficiently to allow for passage of the divider plate bracket, usually about one and one-half inches from the diameter. Grooves are then cut into that end of the ring assemblies for mounting of the rod support strips. The rod support strips are then welded into the grooves. The baffle assembly is then turned over and grooves machined into the rings, rods support strips, etc. for mounting of the rods. The rods are then welded into the machined slots. Transverse slots for passage of the slide bars are next machined into the exterior cylindrical surface of the ring. As illustrated, each baffle is provided with eight such slots separated by an angle of about 45°. The economizer section baffles are then cut diametrically between the juxtaposed inner and outer ring support bars, with sufficient arc of the inner and outer ring being removed to provide a pair of flat rectangular surfaces along the inner and outer ring support bars of each baffle half. The eight longitudinal slide bars are cut to length. The pair of annularly segmentally shaped flow distribution plates are machined to the desired configuration and the apertures drilled. The divider plate brackets are formed and cut to the desired length and width.

Figure 21:
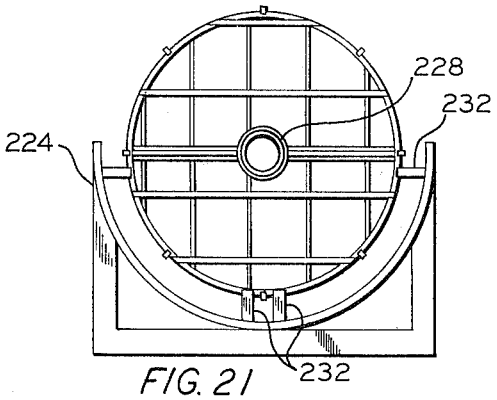
FIG. 21 is a perspective view illustrating certain features of an apparatus according to one embodiment of the present invention.
Figure 22:
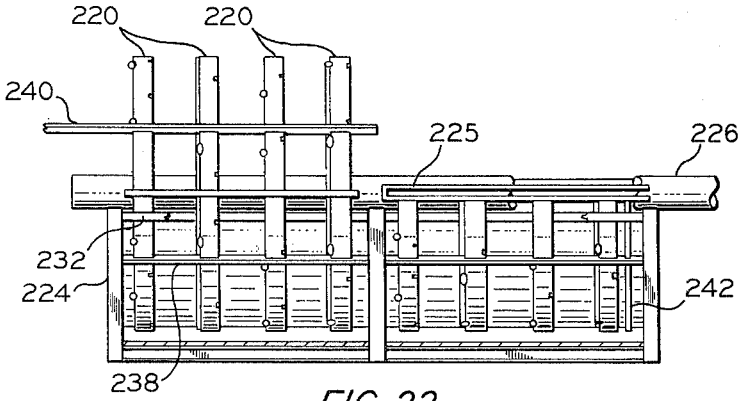
FIG. 22 is a perspective view of an apparatus illustrating certain features according to one embodiment of the present invention.
Figure 23:
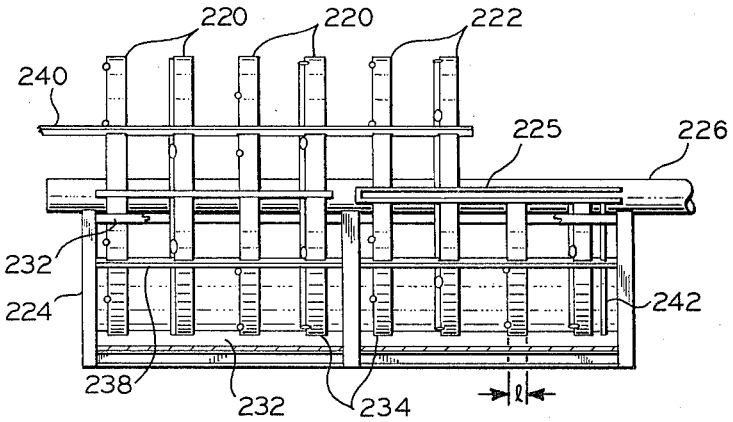
FIG. 23 is a perspective view of an apparatus illustrating certain features according to one embodiment of the present invention.

The next step in the heat exchanger assembly process is the preparation of the various components of the tube bundle. With reference to FIGS. 21–23, the individual baffles of the vaporization section baffle set 220 and the economizer section baffle set 222 are aligned in a fabrication fixture 224. A closely fitting cylindrical center support jig 226 is passed through the center support baffle rings 228 of the vaporization section baffles 220 and laid on the inside of the inner arc-shaped member (184 as shown in FIG. 9) of the economizer baffles 222. The fabrication fixture 224 includes four longitudinally extending bars 232 arranged in parallel and circumferentially about a concentric axis. The surface of each bar 232 which faces generally radially inward is provided with notches 234 at the desired longitudinal baffle spacing, preferably about six inches, with the notches having a sufficient longitudinal length to closely receive each baffle of the set and a sufficient depth to secure each baffle against undesired movement. Fabrication fixture 224 is operative to orient the baffles in substantially vertical parallel spaced apart planes with the baffles being centered about a common axis. The outer arc-shaped members of adjacent baffles lie in juxtaposed relationship. The baffles 222 of the economizer section of the tube bundle are aligned with the outer arc-shaped members opening upwardly and with the ends of the outer arc-shaped members in a substantially horizontal plane and the flow distribution plate brackets 225 preferably being affixed across the inner-outer ring support bars (187 of FIG. 9) of adjacent baffles of set 222. The surface of the flow distribution bypass plate 225 bracket contacting the economizer section baffle of set 222 faces the openings of the outer arc-shaped members is in a horizontal plane aligned normally to the parallel vertical planes of the baffles of the set 222. Each bracket 225 is generally affixed to support bars 187 which lie in a juxtaposed relationship. Preferably, at least one pair of brackets 225 are affixed to the baffles. A pair of clamping fixtures, not shown, is employed to position the other baffles of the segmental baffle pairs on top of the flow distribution plate bracket 225, as shown in FIG. 23. The clamping fixture should cooperate with each of the baffle halves in the fixture 224, the flow distribution plate bracket, and the segmental baffle half on top of the flow distribution plate bracket 225. The segmental baffle half on the opposite side of the flow distribution plate bracket 225 from the baffle half in the fixture is welded to the flow distribution plate bracket 225. Preferably, the baffle halves lie in the same plane, with at least the outer arc-shaped members being in mirror image of each other. The opening of the upper arc-shaped member faces downwardly, toward the brackets, preferably with the ends of the outer arc-shaped member lying in a substantially horizontal plane. Preferably, at least one slide bar 238 is fitted into the transverse notches in the exterior cylindrical surface of the baffles positioned in the fixture 224 and welded before installation of the baffle halves on top of the flow distribution plate bracket 225. Another longitudinal slide bar 240 can be slid down the notches in the exterior surface of the segmental baffle halves to aid in alignment of the baffle halves on top of the flow distribution plate brackets 225 on the flow distribution plate bracket before welding. As illustrated, at least one apertured plate baffle 242 is an integral part of the baffle cage. The apertured plate baffle 242 is supported in the support fixture for alignment and welded to the longitudinally extending slide bar 238 the same as the rod baffles in the baffle cage. The completed baffle cage can be lifted from the fabrication fixture 224 by the center support jig 226. If necessary, the outermost portion of the divider plate brackets 225 can be ground flush with the circumferential exterior surface of the outer baffle rings of set 222. Simultaneous with the assembly of the baffle cage, it is desirable to prepare the U-tubes in the desired configuration and additionally to prepare the supportive structures for the U-bend region of the U-tubes. Additionally, the divider plates and the tube sheet and center support cylinder can be machined.

The next step in the fabrication of the heat exchanger is preparation of the heat exchanger components. The U-tubes are inserted into the baffle cage, beginning with the innermost tubes. As tubing proceeds, the support fixtures for the U-bend region of the tubes are installed. The center support cylinder 136 is affixed to the tube sheet 130 and the divider plates 12 welded to the center support cylinder. The tube sheet 130, center support cylinder 136 and divider plate 12 assembly is then affixed to the end of the tube bundle. The tubes are affixed to the tube sheet 130 conventionally, such as by explosive expansion followed by welding. The cylindrical section of the pressure shell and its bonnets are prepared separately. The channel-forming means are affixed to the inside of the shell. The shroud is assembled with the bosses on its exterior surface and the guide rails on its interior surface.

The completed components of the heat exchanger are assembled as follows. The shroud is suspended over the cylindrical bore of the pressure shell with the cylindrical portion of the shroud above and in axial alignment with the bore of the pressure shell. At least one of the shroud and the pressure shell is moved in a direction toward the other. Preferably, the shroud is lowered into the pressure shell. The shroud is lowered into the pressure shell until the bosses of the shroud are aligned with the channels on the interior surface of the pressure shell. Preferably this is accomplished by lowering the shroud into the pressure shell until the lowermost boss 111 of the shroud contacts the annular flange or lip 66 extending partially around the circumference of the lower portion of the pressure shell. At least one of the shroud and the pressure shell is then rotated so that the boss on the outer surface of the shroud passes at least partially through the circumferentially extending channel and into alignment with the longitudinally extending channel in the pressure shell. Preferably, the shroud is rotated. Preferably, alignment is completed when the boss strikes a longitudinally extending wall of the longitudinal channel 50. At that point at least one of the shroud and the pressure shell is moved in a longitudinal direction so that the boss on the exterior surface of the shroud passes through at least a portion of the longitudinally extending passage to a resting point at one end of the longitudinally extending passage removed from the circumferential passage. Preferably, the shroud is lowered until the boss strikes the bottom of the channel.

The shroud-pressure cell assembly is then rotated into a horizontal orientation. The tube bundle is aligned with the bore of the shroud so that its radially projecting longitudinal guide rails affixed to the baffle rings are in line with the alignment guides extending longitudinally through the bore of the shroud. At least one of the shroud-pressure cell assembly and the tube bundle is moved in a direction toward the other so that the guide rails on the bundle engage with and slide along the alignment guides on the shroud interior surface. Preferably, the tube bundle is slid into the shroud. The tube bundle is slid into the shroud until the vaporizer section of the tube bundle is positioned in the shroud. The dovetails on the outside edges of the divider plates are aligned with the mortises on the inside of the pressure shell, and the bundle is slid the desired distance into the pressure shell/shroud assembly. The tube sheet is welded to the interior surface of the shell along the outside circumference of the tube sheet. The support structures for the U-bend region of the tube bundle are welded to the shroud. The bonnets are welded to the shell and assembly of the heat exchanger is complete.

A specific embodiment of the present invention has dimensions as listed in the following table, which is presented as a non-limiting illustration.

TABLE

| Item | Length[1] | | Radial Thickness[2] | | Circumferential Thickness[3] | | Outside Diameter | | Preferred Material |
|---|---|---|---|---|---|---|---|---|---|
| | In. | (Cm.) | In. | (Cm.) | In. | (Cm.) | In. | (Cm.) | |
| Pressure Shell | 804 | (2042) | 6 | (15.24) | — | — | 247<br>189.5 | (627.4)[5]<br>(1.3)[6] | Carbon steel |
| Shroud | 400 | (1016) | 1.25 | (3.18) | — | — | 169 | (429.3) | Carbon steel |
| Tube Bundle[7] | 396 | (1006) | — | — | — | — | 162.5<br>32 | (413)[8]<br>(81)[9] | Iconel 600 stainless steel |
| Outer Baffle Ring[10] | 1 | (2.54) | 1 | (2.54) | — | — | 164.5 | (417.8) | 409 Stainless steel |
| Tube Support Rod[11] | — | — | — | — | — | — | 0.25 | (0.64) | 409 Stainless steel |
| Rod Support Strips[12] | 1.0 | (2.54) | 0.25 | (0.64) | — | — | — | — | 409 Stainless steel |
| Bundle Slide Bar[13] | 322 | (817.9) | 2 | (5.08) | 1 | (2.54) | — | — | 409 Stainless steel |
| Flow Distribution Plate[14] | 0.5 | (1.27) | — | — | — | — | 166.5 | (422.9) | Carbon steel |
| Tube Sheet | 24 | (60.96) | — | — | — | — | 189.5 | (481.3) | 409 Stainless, clad on bottom with ¼" Iconel 600 |
| Divider Plate | 100 | (254) | 80 | (205) | 2.875 | (7.30) | — | — | 409 Stainless |
| Central Support Cylinder | 100 | (254) | 1.25 | (3.18) | — | — | 28 | (71.12) | 409 Stainless |
| Shroud Boss[15] | — | — | 3 | (7.62) | — | — | 5 | (12.7) | Carbon steel |
| Shell Channel[16] | 11 | (27.9) | — | — | — | — | — | — | Carbon steel |
| Shroud Alignment | 322 | (817.9) | 0.75 | (1.91) | 0.5 | (1.27) | — | — | 409 Stainless |

TABLE-continued

| Item | Length[1] In. | Length[1] (Cm.) | Radial Thickness[2] In. | Radial Thickness[2] (Cm.) | Circumferential Thickness[3] In. | Circumferential Thickness[3] (Cm.) | Outside Diameter In. | Outside Diameter (Cm.) | Preferred Material |
|---|---|---|---|---|---|---|---|---|---|
| Guides[17] | | | | | | | | | |

FOOTNOTES:
[1]Length is measured parallel to the longitudinal axis of the apparatus.
[2]Radial thickness is measured along a radial drawn perpendicular to the longitudinal axis.
[3]Circumferential thickness is measured perpendicular to the radial thickness and in the radial plane.
[4]Outside diameter is the outside diameter of items having a circular cross section.
[5]Upper portion 20 of shell.
[6]Middle portion 40 of shell.
[7]9,840 0.75 in. (1.91 cm) tubes on 1 inch square pitch, having 0.042 in. (0.107 cm).
[8]Outer tube limit.
[9]Inner tube limit.
[10]44 baffles on 6 in. (15.24 cm) longitudinal center-center spacing. 30 unitized baffles in vaporizer section. 14 split baffle pairs in economizer section.
[11]1.75 in. (4.45 cm) spacing.
[12]8 per baffle.
[13]8 at 45° spacing.
[14]2 segments, 9840 apertures in each segment of 0.81 in. (2.06 cm) diameter.
[15]19 each, 90° spacing.
[16]Channel is 6.5 in (16.5 cm) wide, 2 in. (5.08 cm) deep radially, wall is 1 in. (2.54 cm.) thick.
[17]4 pair, 90° spacing; groove is 1.25 in. (3.18 cm.) wide.

Operation of the apparatus having the dimensions as set forth in the above Table is as follows:

Heating fluid enters the apparatus 2 via port 82 at a rate of $82\times10^6$ lbm/hr, a temperature of 621.2° F., and a pressure of 2250 PSIA. The feedwater flows through the tube sheet 130 and enters the hot leg half 14 of the tube bundle 8. The heating medium then flows up the hot leg half 14 of the bundle 8, across the "U" bend region 143 of the bundle 8, and down the cool leg half 16 of the bundle 8, in indirect heat transfer with shell side fluid. The primary feed then flows through the tube sheet 130, and exits the apparatus via port 84, having been cooled to a temperature of 564.5° F.

The main feedwater stream enters the apparatus 2 via ports 52, at a rate of $8.25\times10^6$ lbm/hr, a temperature of 450° F., and a pressure of 1070 PSIA. From the feedwater box 54, the fluid flows downwardly through apertures 61 and across the upper half surface of the tube sheet 130 bounded by the partition plate 12. The fluid then flows upward through the annular passages 212 defined by the outer walls of the tubes 10 of the bundle and the walls of the apertures 210 in the flow distribution plate 208, and into the shell side of the cool leg 16 of the bundle 8. The primary fluid is heated to saturated liquid conditions (552.6° F., 1070 PSIA) during its longitudinal flow upward through the 8.33 ft. long economizer section. The fluid then flows upwardly through the central vaporization section 144 and becomes vaporized to 30% exit quality steam. The fluid then flows into the steam-water separators 94, and the water separated from the fluid forms a pool on the upper surface of the separator deck 38. Steam passing through the steam separators then flows through the steam dryers 26 and out exit ports 24 at a rate of approximately $8.00\times10^6$ lbm/hr, a temperature of about 552.6° F. and a pressure of about 1070 PSIA.

Auxiliary feedwater is introduced onto the steam-water separators deck 38 at a rate of about $2.45\times10^5$ lb/hr, a temperature of about 450° F., and a pressure of about 1070 PSIA, from vertical standpipes 36 fed via inlet port 32. The combined fluids overflow dam 92 and flow down the longitudinal passage 96 having an annular cross section. About 30% of the fluid from the passage 96 is reintroduced into the shell side of the tube bundle 8 via slot 120 above the feedwater box. About 70% of the water in passage 96 is reintroduced into the shell side via slot 122, at the lower end of the hot leg half of the tube bundle. This recirculated water flows across the upper half of tube sheet 130 at a flow rate of approximately $22\times10^6$ lg/hr, a temperature of 552.6° F., and a pressure of 1070. It then is reintroduced into the shell side of bundle 8 by flowing through the annular passages defined by the outer surface of tubes 10 and the walls of apertures 210 in the hot leg half of the flow distribution plate 208. Blow-down fluid can be continuously withdrawn from the apparatus by ports not shown in the tube sheet 130 adjacent the center support cylinder 136 in the hot leg 14 and the cool leg 16 of the bundle 8, preferably, at a continuous rate of about $2.45\times10^5$ lb/hr.

While the invention has been described in terms of the presently preferred embodiments, reasonable variations and modifications are possible by those skilled in the art within the scope of the described invention and the appended claims.

That which is claimed is:

1. Apparatus comprising:

(a) a first rod baffle comprising a first outer arc-shaped member having an arc of about 150° to about 180°, and a first end and a second end; a plurality of rods affixed to the first outer arc-shaped member as chords and a first arc-closure member affixed to the first end of the outer arc-shaped member and the second end of the outer arc-shaped member;

(b) a second rod baffle comprising a second outer arc-shaped member having an arc of about 150° to about 180°, a first end and a second end, a second arc-closure member affixed to the first end of the second outer arc-shaped member and the second end of the second outer arc-shaped member, and a second plurality of parallel rods each rod of the second plurality of parallel rods affixed by one end to the second outer arc-shaped member and by the other end to the arc-closure member;

and (c) at least one support member affixed to each of the first arc-closure member and the second arc-closure member so as to retain the outer arc-shaped member and the arc-closure member of the first rod baffle in juxtaposed relationship with the outer arc-shaped member and the arc-closure member of the second rod baffle;

wherein each of the first arc-closure member and the second arc-closure member comprises an inner arc-shaped member in juxtaposed relationship with the outer arc-shaped member and having a first end and a second end and a first elongate member extending between the first end of the inner arc-shaped member and the first end of the outer arc-shaped member and a second elongate member extending between the second end of the inner arc-shaped member and the second end of the outer arc-shaped member and wherein the at least one support member comprises a U-shaped bracket with each of the first baffle and the second baffle affixed to the outside edge of one of the legs of the U-shaped bracket.

2. An apparatus as in claim 1 wherein the rods have a circular cross section.

3. An apparatus as in claim 2 further comprising a plurality of parallel tubes positioned through the first rod baffle and the second rod baffle so as to be supported by the rods in the first rod baffle and the second rod baffle.

4. An apparatus as in claim 3 wherein the plurality of parallel tubes form a first leg of a tube bundle having a first leg of parallel tubes and a second leg of parallel tubes and the second leg of parallel tubes of the tube bundle is positioned parallel to the first leg of tubes and adjacent to the outside edge of the other of the legs of the U-shaped bracket.

* * * * *